US010758834B2

(12) United States Patent
Klein

(10) Patent No.: US 10,758,834 B2
(45) Date of Patent: Sep. 1, 2020

(54) MODEL TRACKS FOR TOY VEHICLES

(71) Applicant: Shmuel Klein, Lakewood, NJ (US)

(72) Inventor: Shmuel Klein, Lakewood, NJ (US)

( * ) Notice: Subject to any disclaimer, the term of this patent is extended or adjusted under 35 U.S.C. 154(b) by 0 days.

(21) Appl. No.: 14/853,804

(22) Filed: Sep. 14, 2015

(65) Prior Publication Data

US 2016/0074762 A1 Mar. 17, 2016

Related U.S. Application Data

(60) Provisional application No. 62/050,365, filed on Sep. 15, 2014.

(51) Int. Cl.

| | |
|---|---|
| ***A63H 18/02*** | (2006.01) |
| ***A63H 19/28*** | (2006.01) |
| ***A63H 33/42*** | (2006.01) |
| ***A63H 19/30*** | (2006.01) |

(52) U.S. Cl.

CPC ..... *A63H 18/02* (2013.01); *A63H 19/28* (2013.01); *A63H 19/30* (2013.01); *A63H 33/42* (2013.01)

(58) Field of Classification Search

CPC ..... A63H 18/02; A63H 19/28; A63H 19/30; A63H 33/42

USPC ..... 446/108, 114, 115, 124, 174

See application file for complete search history.

(56) References Cited

U.S. PATENT DOCUMENTS 2,254,810 A 9/1941 Will
2,916,839 A * 12/1959 Wheaton ..... G09F 7/06 248/216.1
3,013,726 A * 12/1961 Orel ..... A63H 18/02 238/10 E
3,658,333 A * 4/1972 Carcel ..... A63F 9/14 463/69
4,154,019 A 5/1979 Neuhierl
5,890,948 A * 4/1999 Nilsson ..... A63H 33/044 14/2.4
5,967,052 A * 10/1999 Prokopf ..... A63H 18/02 104/126
6,093,079 A * 7/2000 House ..... A63H 18/02 238/10 E
6,398,121 B1 6/2002 Morgan
6,409,091 B1 6/2002 Simpson
6,427,926 B1 * 8/2002 Lai ..... A63H 18/02 104/53
6,431,936 B1 8/2002 Kiribuchi
6,883,719 B2 4/2005 Pyrce
7,192,628 B2 * 3/2007 Burrows ..... A63H 33/26 235/449

(Continued)

OTHER PUBLICATIONS

Wo2009/127303A1.*

*Primary Examiner* — Vishu K Mendiratta

(74) *Attorney, Agent, or Firm* — Gabriel & Pelaez, PLLC; Michael G. Gabriel

(57) ABSTRACT

Embodiments of the invention includes a play set having multiple configurations. The play set include a plurality of track segments that are configured to be selectively connected to each other in a variety of configuration. The track segments include a plurality of main track segments, a plurality of intersection pieces and a plurality of curved track segments. Each track segment includes at least one magnetic element embedded within a thickness of the track segment. Each track segment can be directly connectable to other track segments through the magnetic elements.

18 Claims, 17 Drawing Sheets

(56) References Cited

U.S. PATENT DOCUMENTS

| | | | | |
|---|---|---|---|---|
| 7,690,963 | B2 | 4/2010 | Whitehead | |
| 8,282,438 | B2 | 10/2012 | Tamulewicz et al. | |
| 8,776,695 | B2 * | 7/2014 | Ho | A63H 19/30 104/124 |
| 2010/0248586 | A1 * | 9/2010 | Cochella | A63H 18/02 446/444 |
| 2010/0258646 | A1 * | 10/2010 | Tamulewicz | A63H 18/02 238/10 B |
| 2011/0065357 | A1 * | 3/2011 | Morgan | A63H 19/10 446/444 |

* cited by examiner

MODEL TRACKS FOR TOY VEHICLES

CROSS-REFERENCE TO RELATED APPLICATIONS

This Non-Provisional Application claims the benefit of U.S. Provisional Application No. 62/050,365, filed Sep. 15, 2014, the entire contents of which is herein incorporated by reference.

TECHNICAL FIELD

This invention relates to a playset for toy vehicles and, more particularly, to a toy track with connectable model tracks for toy vehicles.

BACKGROUND OF THE INVENTION

Various toy play sets, for example, toy track sets, surfaces, and items are designed for use with toy vehicles such as, for example, for use with toy railroad, cars, and trucks. Typically, these toy sets are assembled by inter-connecting the various shapes and sizes of tracks in a specific manner to form the desired pattern over which to roll the toy vehicle.

Conventional toy track sections are limited in the way they are attached to other track sections. The typical attachment of tracks is a puzzle style or male to female attachment where a track section is coupled to another track section by connecting portions or connectors. Further, these toy tracks, for example, those that tend to mimic railroad track systems, are arranged to typically follow a figure-of-eight or similar track pattern, always curving on a turn. Such track sections are limited in the number of directions in which the tracks can be assembled. These attachments create problems of mismatch, gaps and/or uneven surfaces.

Conventional toy play sets and items may incorporate magnetism, or interlocking connections to attach the track pieces to each other. Play sets that use magnetism to create the playing structure, a play mat is used that contains a layer of magnetic or magnetically attractive material. A structure can be built on the play mat using a set of tracks, set of connectors, and a set of structural elements, all of which containing magnetic or magnetically attractive material. However, for the structure to be assembled, the play mat is essential.

Further, these toy track sets are limited in their arrangement of track pieces. These play sets have predetermined lengths and curvatures of track pieces that cannot be altered by the user. As such, track variations of conventional track sets have set ups that cannot be altered and lack an element of realism. Therefore, a toy track that overcomes the deficiencies of the conventional toy play sets would be well received.

SUMMARY OF THE INVENTION

An embodiment of the invention includes a play set having multiple configurations. The play set include a plurality of track segments that are configured to be selectively connected to each other, comprise a plurality of main track segments, intersection pieces and curved track segments. The plurality of track segments allows a grid configuration and unlimited layouts of the track segments.

Other embodiments include a main track segment with a main track body having first top and bottom surfaces, a first thickness, two main track end faces and at least one magnetic element embedded within the first thickness at each main track end face, wherein a first length of the main track segment is twice a width of the main track segment. The main track segment is configured to be directly connectable to an intersection piece at the main track end faces and the intersection end face.

An embodiment of an intersection piece includes an intersection piece body with second top and bottom surfaces, a second thickness, four intersection end faces and at least one magnetic element embedded within the second thickness at each intersection end face, wherein a second length of the intersection piece is equal to a width of the intersection piece.

An embodiment of a curved track segment includes a curved track body with third top and bottom surfaces, a third thickness, curved track end faces and at least one magnetic element embedded within the third thickness at each curved track end face.

In an embodiment, two main track segments are connectable at 90 degrees via the intersection piece, the intersection piece directly adjoining each of the main track segments via two directly adjacent intersection end faces.

In another embodiment, a method of using a playset, includes providing a plurality of track segments, wherein the plurality of track segments comprise: a plurality of main track segments, a plurality of intersection pieces, and a plurality of curved track segments. Each track segment includes at least one magnetic element embedded within a thickness of each segment; directly connecting the main track segment to the intersection piece at the main track end faces and the intersection end face; wherein two main track segments of the plurality of main track segments are connectable at 90 degrees via the intersection piece, the intersection piece directly adjoining each of the main track segments via two directly adjacent intersection end faces.

DETAILED DESCRIPTION OF INVENTION

In the following description, for purposes of explanation, numerous specific details are set forth in order to provide a thorough understanding of the invention. It will be apparent, however, to one skilled in the art that the invention may be practiced without these specific details. In other instances, structure and devices are shown in block diagram form so as to avoid obscuring the invention. References to numbers without subscripts or suffixes are understood to reference all instance of subscripts and suffixes corresponding to the referenced number. Moreover, the language used in this disclosure has been principally selected for readability and instructional purposes, and may not have been selected to delineate or circumscribe the inventive subject matter, resort to the claims being necessary to determine such inventive subject matter. Reference in the specification to "one embodiment" or to "an embodiment" means that a particular feature, structure, or characteristic described in connection with the embodiments is included in at least one embodiment of the invention, and multiple references to "one embodiment" or "an embodiment" should not be understood as necessarily all referring to the same embodiment.

Figure 1:
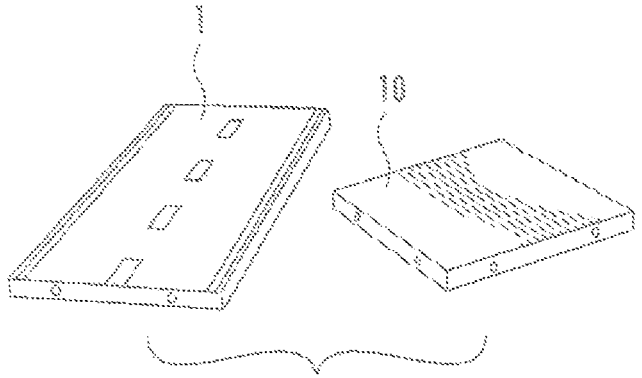
FIG. 1 is a diagram illustrating a perspective view of a main track segment and an intersection piece according to one embodiment.

Referring to the figures, FIG. 1 depicts an example track configuration according to an embodiment of the invention. In an example, the track pieces are a main track segment 1 and an intersection track segment 10. Main track segment 1 and intersection track segment 10 may represent road segments that are configured to receive toy vehicles. While track segments 1 and 10 are shown as linear pieces, other track having a ¼th of a circle track segment, a ⅛th of a circle track segment, two ⅛th of a circle splitting into two directions, 1/16 and other similar shapes that provides unlimited layouts of track segments may also be used.

In one example, the main track segment 1 and the intersection piece 10 may be attached to each other by magnets that are embedded in the thickness of the track segment. In embodiments, magnets may provide an attractive force at one or more end faces of each track piece, as will be described below. In other embodiment, one or more of the main track segments 1 and the intersection track segments 10 can be attached to other main track segments 1 and/or intersection segments 10. As the magnets are embedded in the thickness of the track segments, there are no protrusions at the end of the tracks which facilitates attaching the pieces using the attractive force or corresponding magnets which causes the track segments, for example, track segments 1 and 10 to butt-up against each other with minimal or a negligible gap and using the magnetic pull or attraction of respective magnets in the each track segment holding them together. Track segments 1 and 10 may be painted on a top surface to depict a road surface, sidewalk, grass, or other similar road segment. Track segments 1 and 10 can also include train tracks formed on the top surface, electrical grid for receiving radio-controlled cars, or other similar features to enhance the appeal and play of a user of the track segments. These alternative surface designs may be on the top surface 3 or may be printed or formed on the bottom surface 4 to provide for an alternative playing surface or environment.

Figure 2:
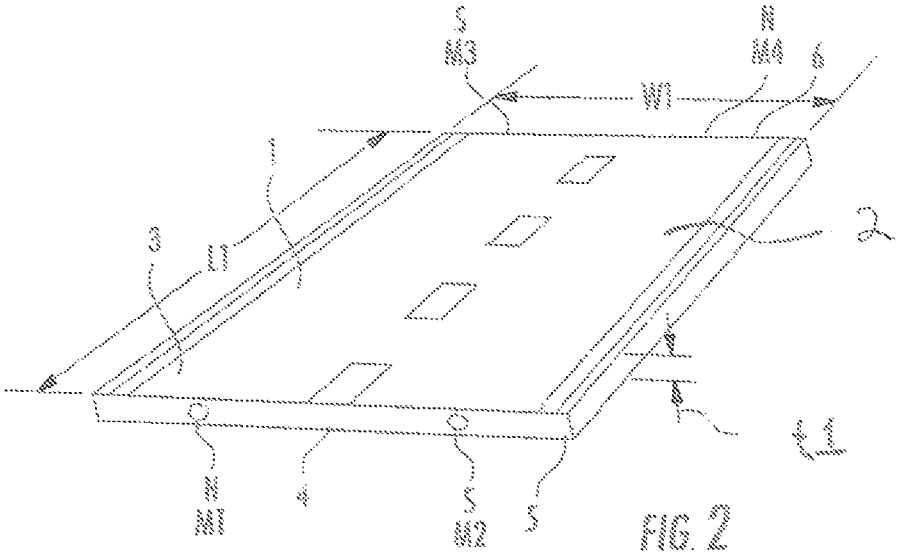
FIG. 2 is another diagram illustrating a perspective view of the main track segment shown in FIG. 1 according to one embodiment.

FIG. 2 depicts another perspective view of main track segment 1. As shown in FIG. 2, the main track segment 1 includes a main track body 2 oriented along a longitudinal axis with first top 3 and bottom surfaces 4, a first thickness t1, two main track end faces 5 and 6 and magnetic elements M1 and M2 embedded within the first thickness a at each main track end face 5 and 6. In one embodiment, a first length L1 of the main track segment 1 is twice a width W1 of the main track segment 1. There are two magnets at each end face 5 and 6 (for example, magnetic elements M1 and M2 on face 5), one magnetic north and one magnetic south, and this pattern is reversed on the opposite end face 6. The orientation of the magnets for each main track segment facilitates that two main track segments 1 may be attached to each other at the end faces 5 and 6 when the main track segment 1 is oriented with the top surface facing upwards.

Figure 3:
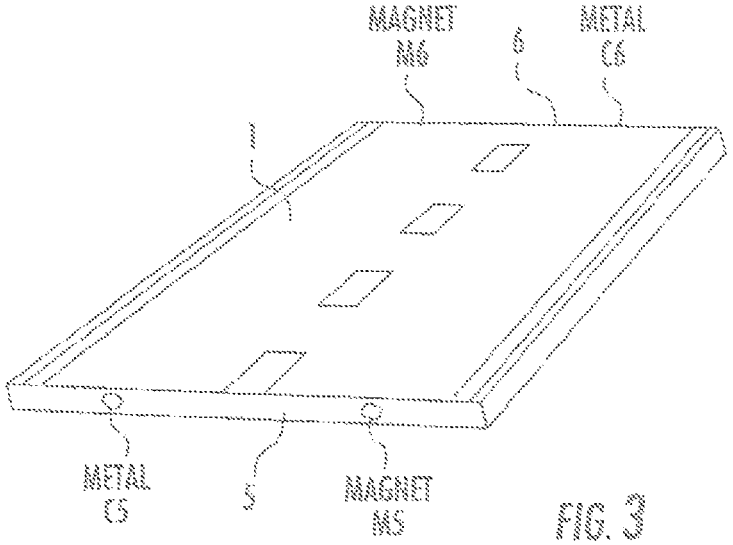
FIG. 3 is a diagram illustrating a perspective view of a main track segment showing magnetic and magnetically attractive metal elements according to one embodiment.

In another embodiment, as shown in FIG. 3, each end face 5 and 6 may include one magnet M5, M6 and one metal cylinder C5, C6 that is attracted to a magnetic field (e.g., steel), with the magnetic element M5 on end face 5 being diagonally opposite the magnetic element M6 on the opposite end face 6. The main track segment 1 may be made of wood, but other known materials, including plastic, poly or any other material which would enhance the usage of this product may also be used.

Figure 4:
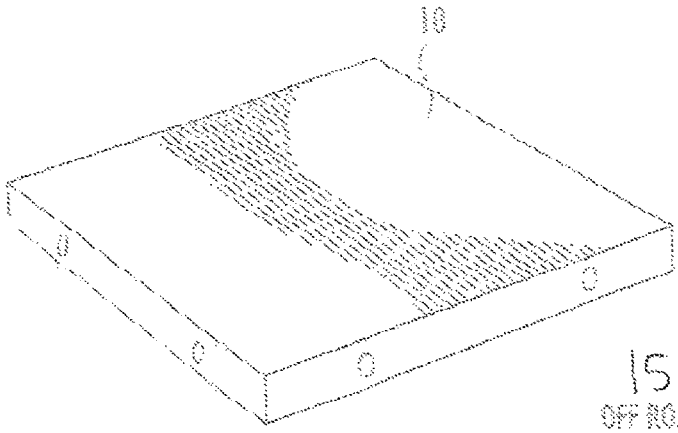
FIG. 4 is a diagram illustrating a perspective view of one intersection piece according to one embodiment.

FIG. 4 depicts an embodiment of an intersection segment 10. Intersection segment 10 is substantially similar to main track segment 1 with respect to the use of magnetic elements and metal cylinders. However, intersection segment 10 may include magnetic elements on each end face so that any end face may be attached to other main track segments 1 or other intersection segments 10 at the end faces. The intersection track segment 10 may have eight magnets, two on each end face. This allows for multi-directional attachment, allowing for unlimited layouts with other intersection segments 10 or other track segments. Each intersection segment 10 is generally square that facilitates attaching the other road track segment to the intersection segment 10 on a 90 degree angle like a realistic street grid.

As shown in FIG. 1-4, each main track segment 1 and intersection track segment 10 may be printed, painted or decaled so that the upper track surface looks like a real street, with lines down the middle and shoulder stripes. Also, different terrains could be printed on the tracks segments, such as printing a dirt path mimicking an ATV or off road setting, snowy roads and cobblestone. The printed terrains may have minimal or negligible thickness as compared to a track segment thickness without a printed scene.

Figure 5:
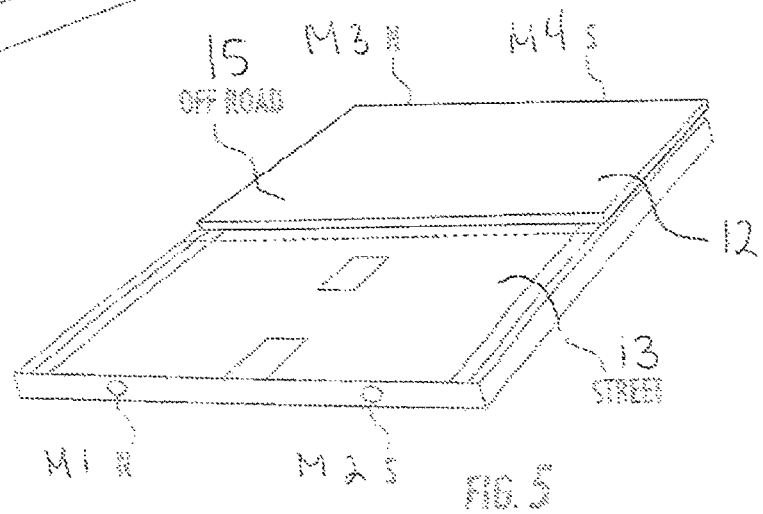
FIG. 5 is a diagram illustrating a perspective view of two track segments showing a smooth edge attachment according to one embodiment.

FIG. 5 shows an embodiment of using a plurality of printed scenes on an upper surface of a track segment. For two sided track segments, for example, track segment 1 could have different scenes printed on a surface of either side of track segment 1. In another embodiment, a track segment may have a single scene painted on the top surface. The double sided tracks may be used separately with one scenery at a time or may be used simultaneously using a special connector or transition piece 12 having on the top surface of the first transition segment a road surface 13 and an alternative surface 15. The connector piece 12 may have north and south magnetic elements connecting to other track segments. Also, where the printed terrains may be printed directly on either the top surface 3 or on the bottom surface 4 of track segment 1, a transition piece 12 may be provided as illustrated in FIG. 5. The transition piece or connector piece may have magnets embedded in its end faces with the polarity switched from the other track segments. In other words, track segments 1 have at M1 and M4 N polarity magnets and at M2 and M3 have S polarity magnets, but a transition piece will have a M1 and M3 N and M2 and M4 S polarity magnets. The transition piece 12 could be placed between a track segment 1 with surface 3 on top and a track segment 1 with surface 4 facing upward, maintaining the attractive forces for the reversed or flipped track segments 1, allowing a user to switch from a road surface 13 to an alternative surface 15.

Figure 6:
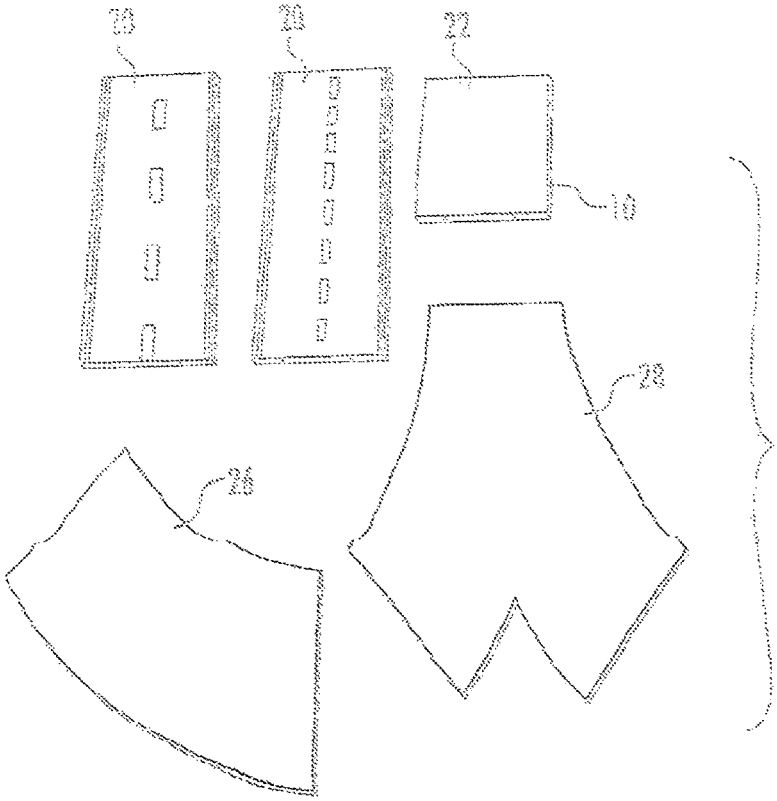
FIG. 6 is diagram illustrating a perspective view of a plurality of track segments according to one embodiment.
Figure 7A:
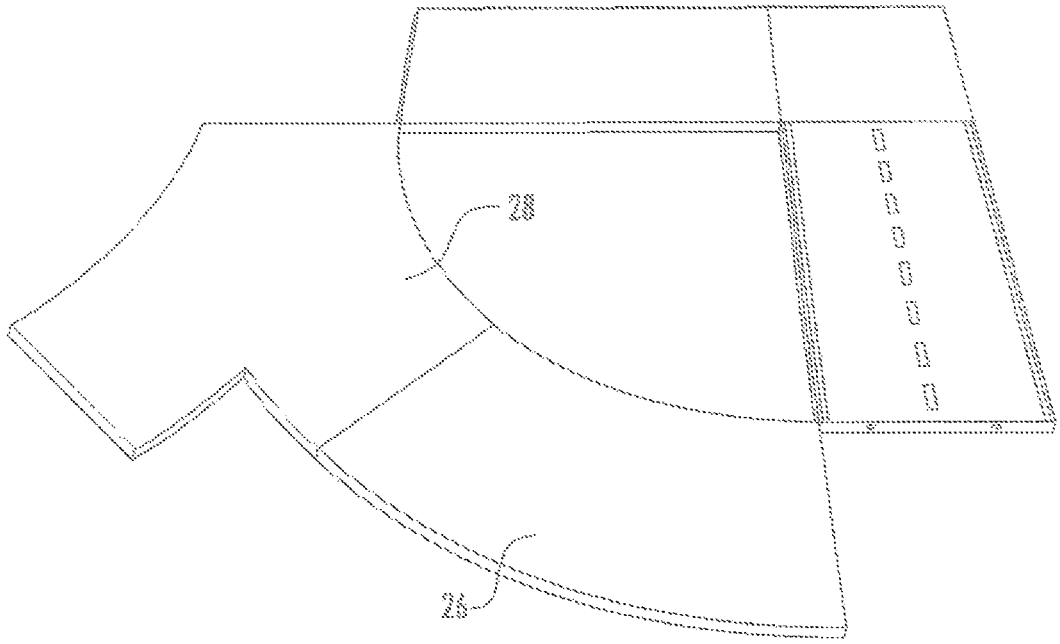
FIG. 7A is diagram illustrating a perspective view of an arrangement of main track segment with an intersection piece and curved track segments according to one embodiment.
Figure 7B:
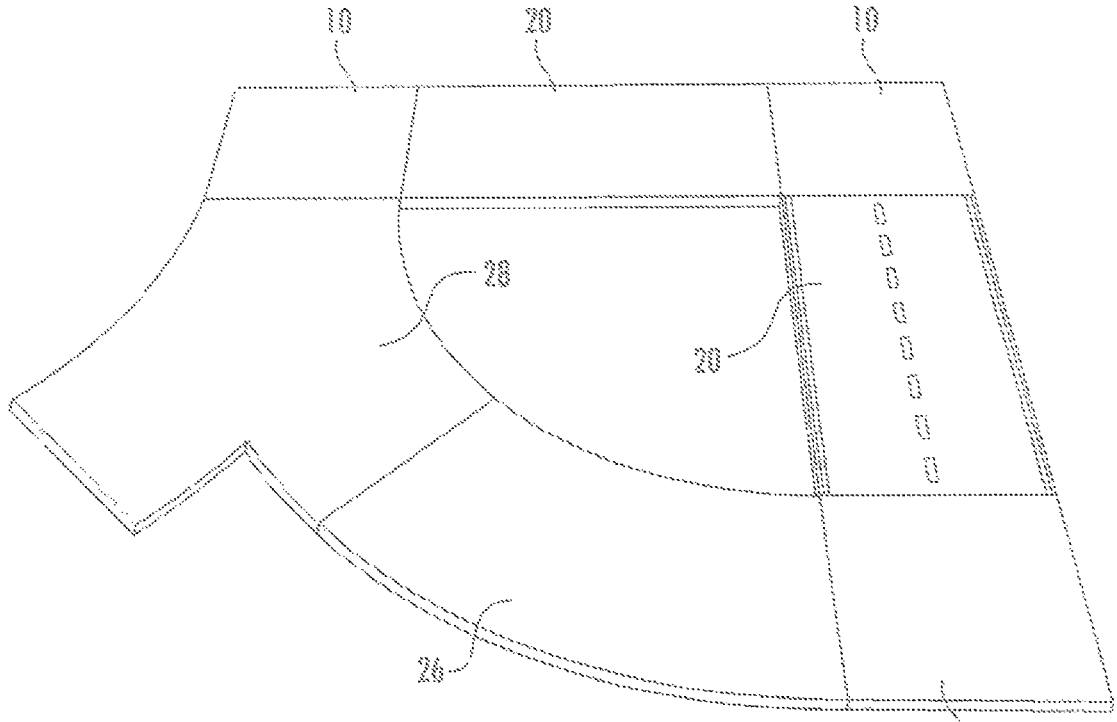
FIG. 7B is a diagram illustrating a perspective view of an arrangement with corner intersection pieces according to one embodiment.
Figure 8A:
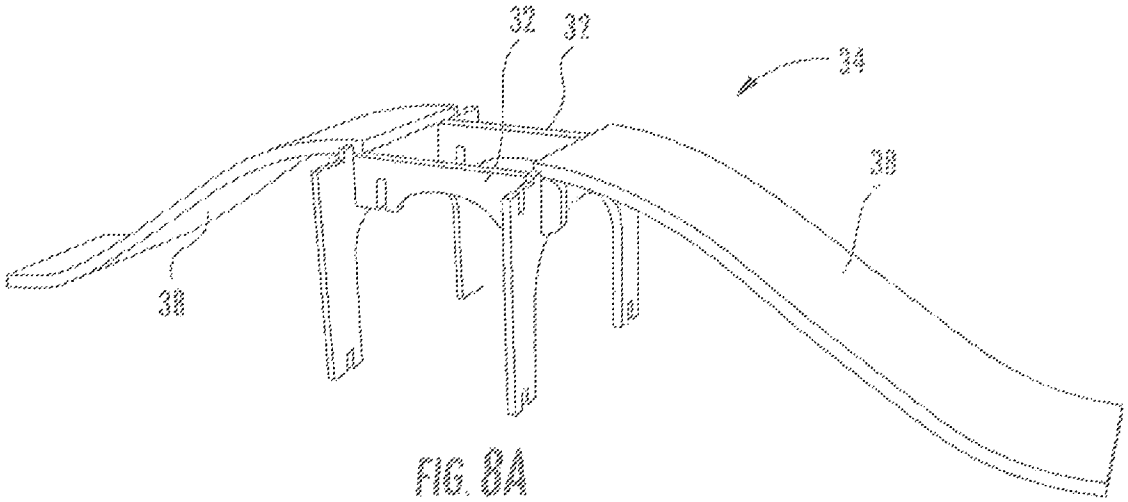
FIG. 8A is a diagram illustrating a perspective view of an arrangement of a bridge using risers and curved ramps according to one embodiment.
Figure 8B:
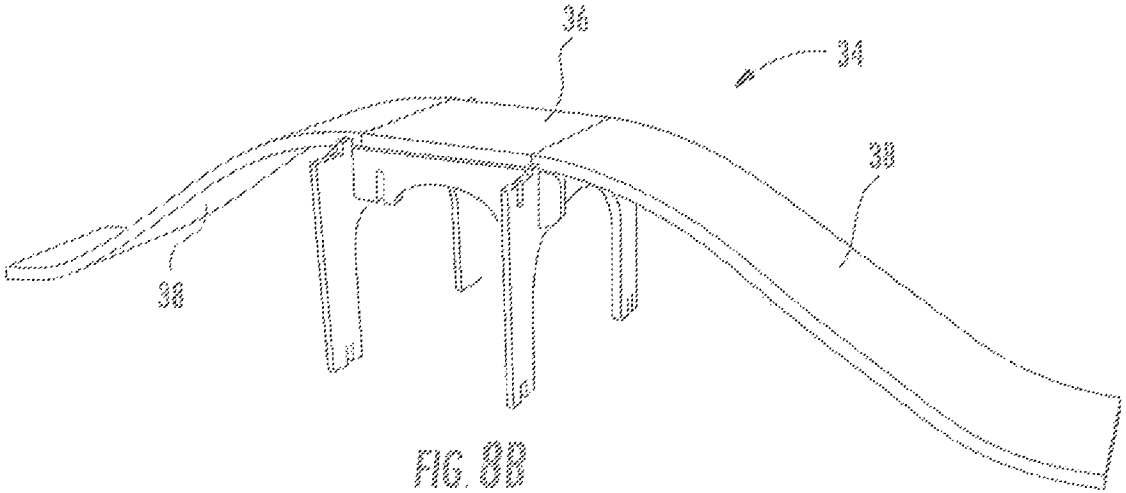
FIG. 8B is a diagram illustrating a perspective view showing an arrangement of a bridge using risers, curved ramps and an intersection piece according to one embodiment.

In another embodiment, as shown in FIGS. 6-7B, track segments may include a plurality of curved shapes and lengths that allows a grid configuration and unlimited layouts. For example, as shown in FIG. 6, the shapes of track segments can include, in some non-limiting embodiments, a full length of track segment 20 (such as a main track segment), half-length of track segment 22, intersections 10 (same as ½ length track segment 10), $\frac{1}{8}^{th}$ of a circle track segment 26, two $\frac{1}{8}^{th}$ of a circle splitting into two directions 28, so as to represent a fork in the road, $\frac{1}{16}^{th}$ of a circle (not shown) and other similar shapes that provides unlimited layouts of track segments. The length of the track segments can vary in length so that they will always join together in a grid layout or other layouts without being limited to the pieces that are being utilized. Each intersection 10 or ½ length track segment 22 is half the length (½ L1) of the full length (L1) track segment 20. Also shown in FIGS. 7A and 7B, a length of two pieces of $\frac{1}{8}^{th}$ curve track segment 28 connected to $\frac{1}{8}^{th}$ of a circle track segment 26 along an edge of track segment 28 will add up to create a corner the same length as a full length piece 20. Particularly, as shown in FIG. 7B, two circle track segments of $\frac{1}{8}^{th}$ of a circle each may have an inner radius equal in length to L1 (26 and 28), and two full length track segments 20 connected at 90 degrees with an intersection track segment 10 with additional intersection track segments 10 at the corners forms a section of a circle. In another embodiment, several ⅛ circle track segments 26 may be connected together (not shown) to create a complete circle representing as realistic roundabout in certain scenarios.

FIGS. 8A-11F depict track components that facilitate building multiple levels of track according to an embodiment of the invention. For example, as shown in FIG. 9-11B, track components could be risers 30 (or called an arch) and support bars 32A-32E that create bridges 34 (See FIG. 8A-8B) allowing for building multiple levels of track. The risers 30 and support bars 32A-32E may connect to track segments, for example, track segments 1, 10 and 20, and provide for different scenes such as highways, or mountainous regions. The bridges (shown in FIGS. 8A and 8B) may include curved ramps 38 (shown in FIGS. 8A-8B and 11C) that sit on the edge of the risers 30 with a platform piece 36 (shown in FIGS. 8B and 11C) on top support bars 32 extending between the risers 30.

Figure 9:
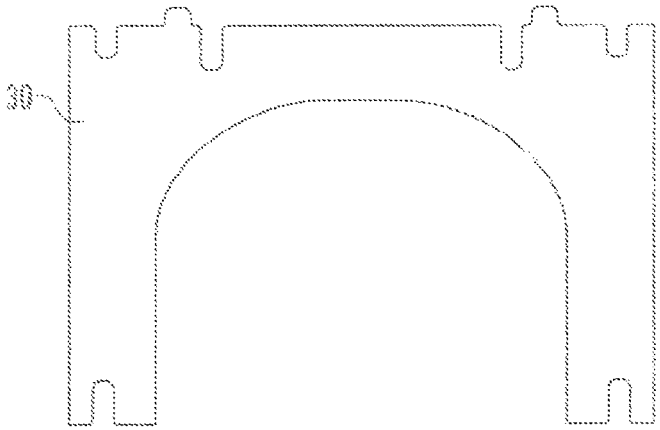
FIG. 9 is a diagram illustrating an elevation view of a riser according to one embodiment.
Figure 10:
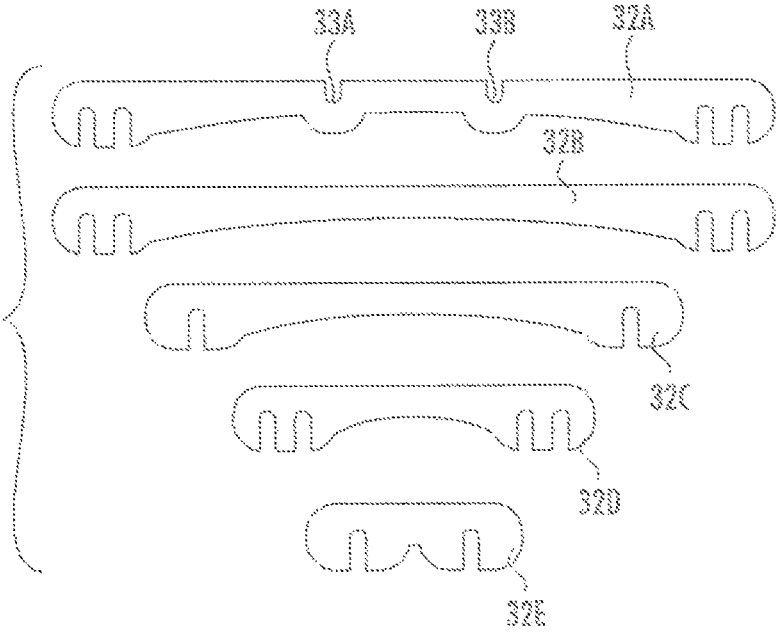
FIG. 10 is a diagram illustrating an elevation view of a plurality of support bars according to one embodiment.

As shown in FIGS. 9-10, riser 30 is configured to be generally vertically oriented with respect to the track segments and can include vertical columns that are connected together with a horizontal segment. The horizontal segment can include protrusions that may receive track segments, while the vertical columns include groves that are configured to receive respective grooves in support bard 32A-32E.

Figure 11A:
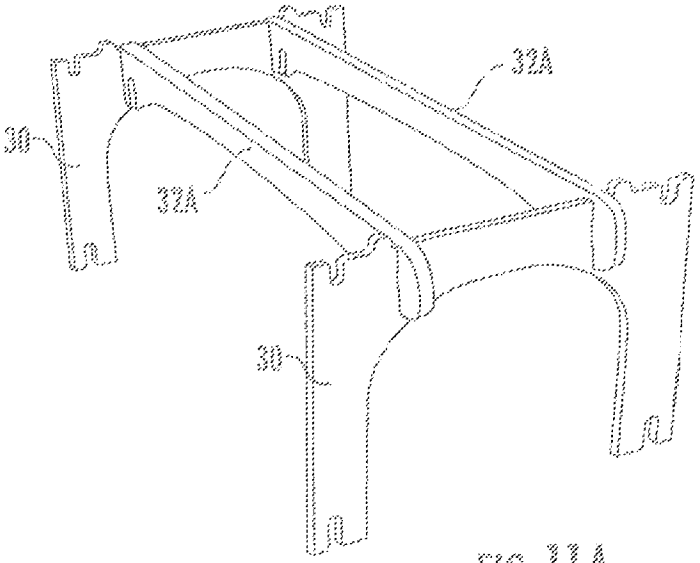
FIG. 11A is a diagram illustrating a perspective view of an arrangement of support bars and risers according to one embodiment.
Figure 11B:
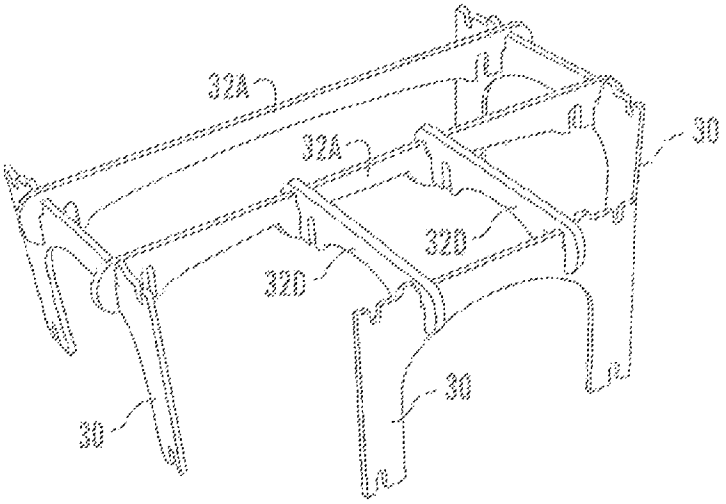
FIG. 11B is a diagram illustrating a perspective view of another arrangement of support bars and risers according to one embodiment.
Figure 11C:
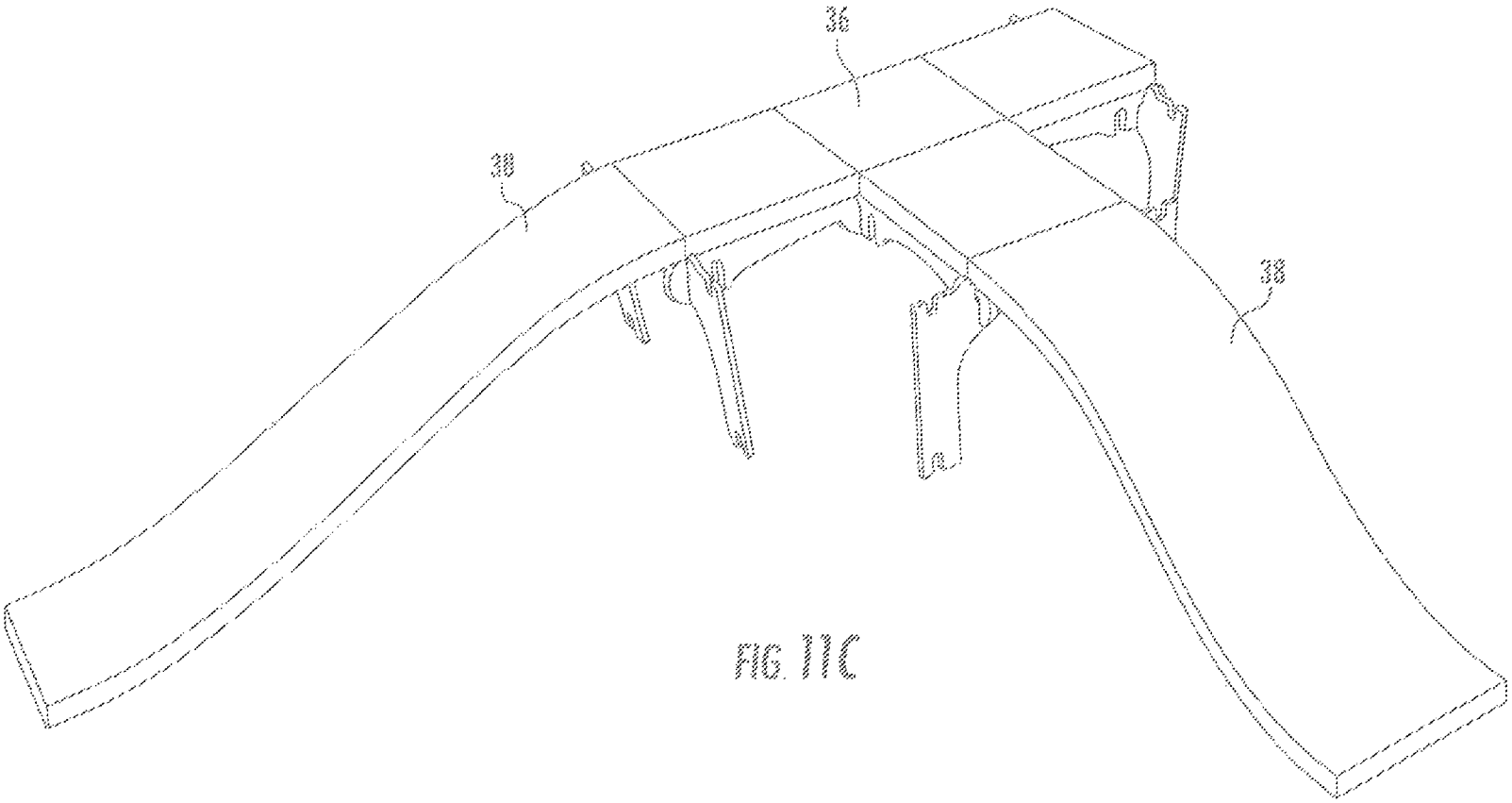
FIG. 11C is a diagram illustrating a perspective view of an arrangement of support bars and risers shown in FIG. 11A but which is shown with curved ramps and an elevated platform according to one embodiment.

Particularly, as shown in FIGS. 10 and 11A-11B, support bars 32 includes grooves at each end of the support bars 32. The grooves slip into the inner grooves of the risers 30 at a top end of the riser 30. In one embodiment, as shown in FIG. 10, support bar 32A may also include additional support grooves 33A-33B that may receive additional support bars 32A-32E, as shown in FIG. 11B. The curved ramps 38 (FIG. 8A-8B) may also have magnets on their respective edges and will usually be 1½ length of track. The platform pieces 36 may be ½ length segments 22, full length segments 20, or 1½ length segments. Having platform pieces of several lengths functions to ensure that all the connected track segments and pieces end up connecting together with whatever configuration a user chooses on the level below the underpass. Further, using the risers 30 and support bars 32 functions to create a more realistic street grid layout with multiple levels of track that is novel over the prior art.

Figure 11D:
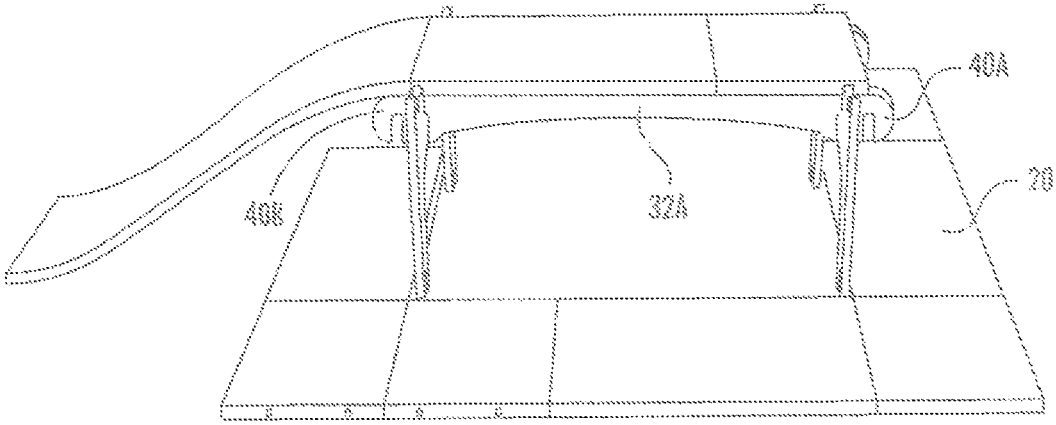
FIG. 11D is a diagram illustrating a perspective view of an arrangement of support bars and risers according to FIG. 11A but which is shown with a slot selection on the support bar according to one embodiment.
Figure 11E:
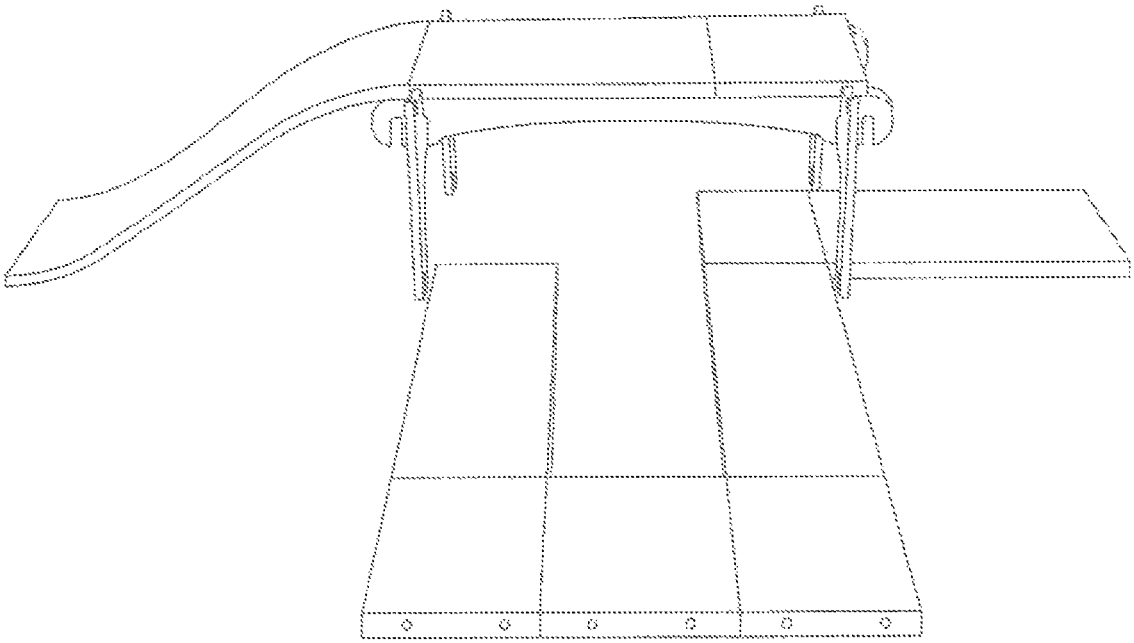
FIG. 11E is a perspective view of another arrangement of support bars and risers according to FIG. 11A but which is shown with a different slot selection on the support bar according to one embodiment.
Figure 11F:
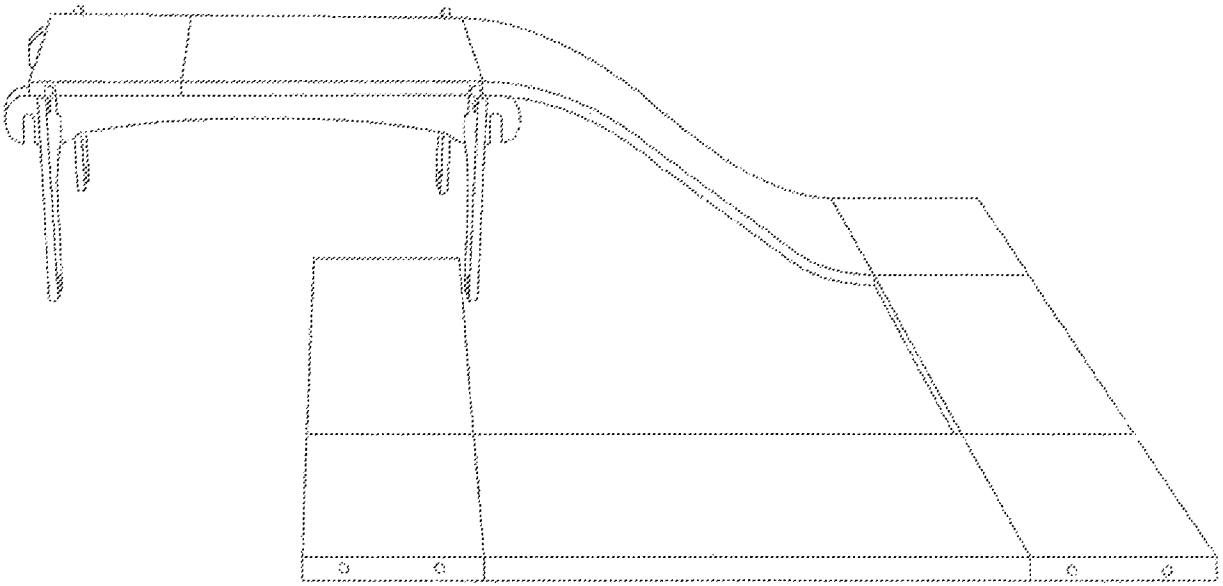
FIG. 11F is a diagram illustrating a perspective view of an arrangement of support bars and risers according to FIG. 11A but which is shown with connecting curved ramp pieces, main track segments and intersection pieces according to one embodiment.

As shown in FIG. 11D, there may be two slots 40A and 40B at each end of the support bar 32A. The slots 40A and 40B may be connected to respective slots in the riser 30 so that the space under each support bar 32A may be changed. For example, slots 40A and 40B may enable that arch or riser 30 could either stand on the inside of a track segment, for example, track segment 20. In another embodiment, shown in FIG. 11E, the slots 40A-40B may be connected to the support bar 32A to assure that the riser 30 may stand on the outside of the track segment 20. This ensures that a road and bridge formed from track segments can always meet and connect, as shown in FIG. 11E.

Figure 12A:
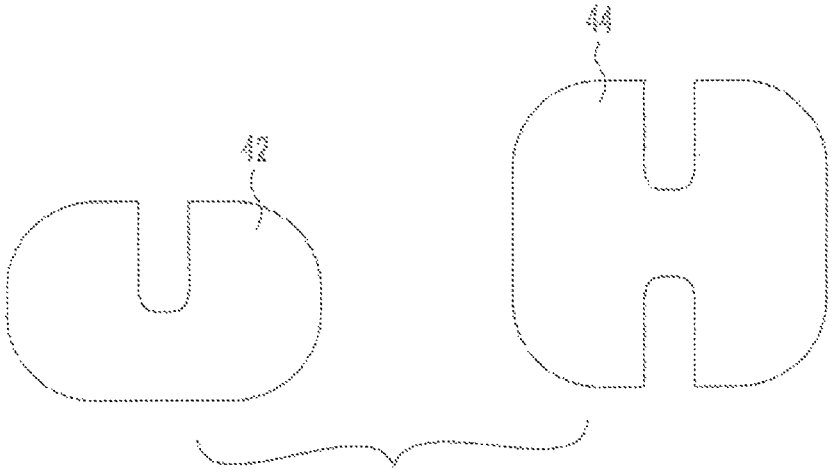
FIG. 12A is a diagram illustrating an elevation view of a base and a connector according to one embodiment.
Figure 12B:
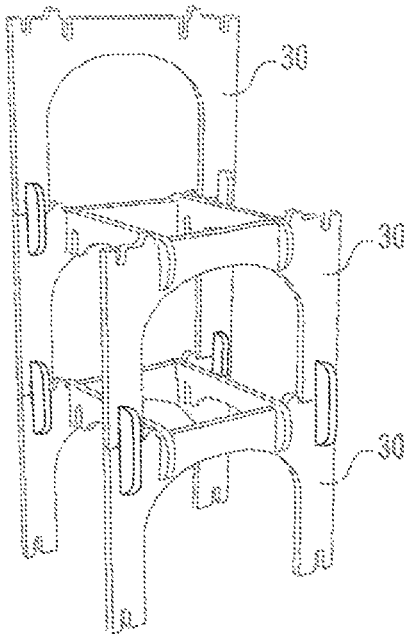
FIG. 12B is a diagram illustrating a perspective view of a multi-level construction with risers and support bars according to FIG. 11A and with connectors according to FIG. 12A according to one embodiment.
Figure 13:
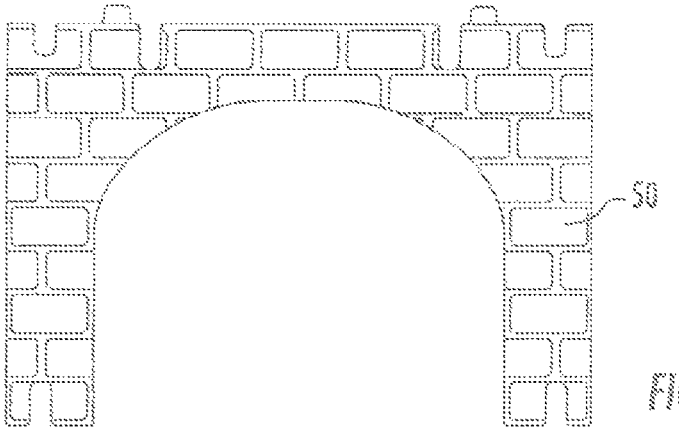
FIG. 13 is diagram illustrating an elevation view of a riser showing a realistic element according to one embodiment.

FIG. 12A illustrates use of base pieces 42 and 44 to aid in stabilizing the footings of the risers 30. The base pieces 42 and 44 can include connectors which allow for stacking one riser 30 top of another, as shown in FIG. 12B. Stacking enables multi-level construction. In an embodiment, shown in FIG. 13, a riser 50 may also be printed, painted or decaled to add a realistic element.

Figure 14A:
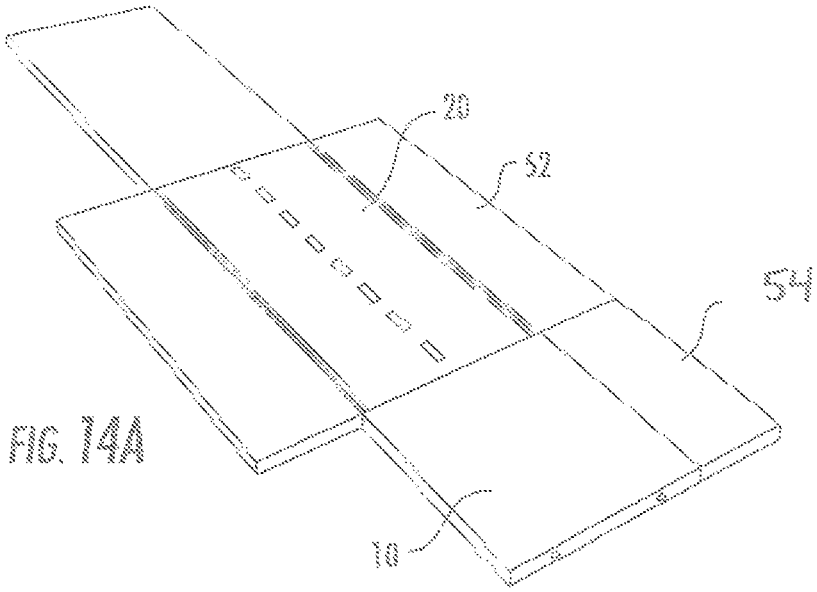
FIG. 14A is a diagram illustrating a perspective view of an arrangement with a main track segment, intersection piece and off-road pieces according to one embodiment.
Figure 14B:
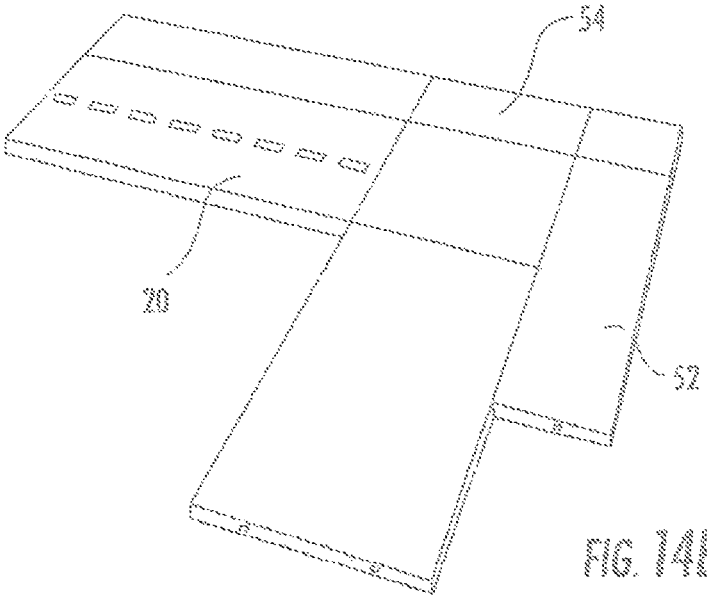
FIG. 14B is a diagram illustrating a perspective view of another arrangement with a main track segment, intersection piece and off-road pieces at a corner according to one embodiment.
Figure 15:
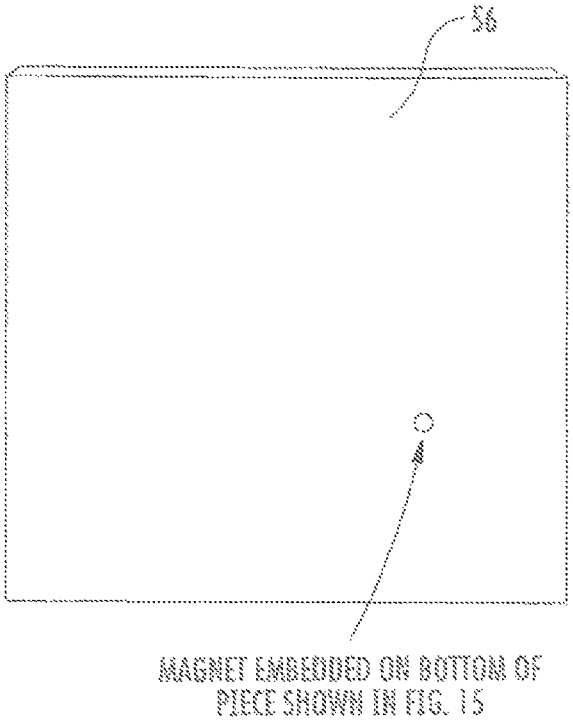
FIG. 15 is a diagram illustrating a perspective view of an off-road track segment with a magnet on its bottom surface according to one embodiment.
Figure 16A:
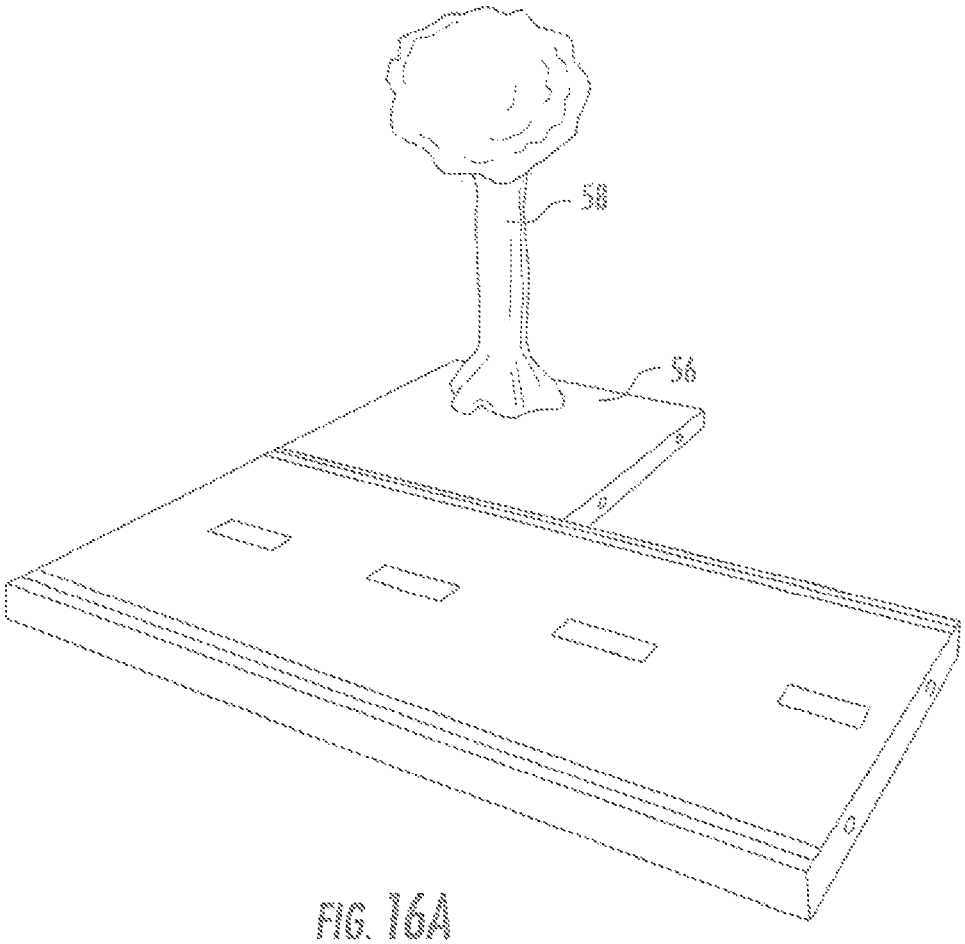
FIG. 16A is a diagram illustrating a perspective view of a scenic accessory attached to a road segment according to one embodiment.
Figure 16B:
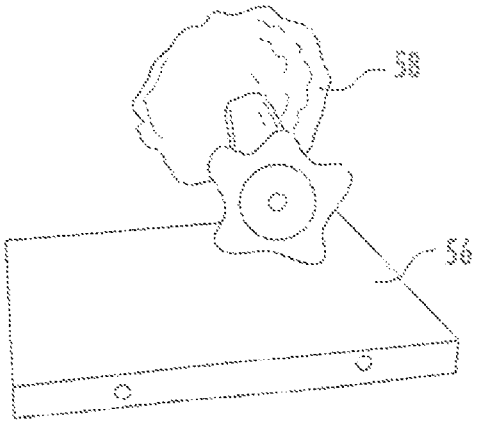
FIG. 16B is a diagram illustrating a perspective view of a scenic accessory attached to a road segment according to one embodiment.

FIGS. 14A-17 illustrate embodiments of scenic accessories for use with track segments. As shown in FIGS. 14A and 14B, the track segments, for example, track segments 10, 20 may be used with different size pieces of scenery pieces or segments, for example, sidewalks 52, grass 54 so as to fit various configurations. Scenery segment 52 is half the width (½ W1) of the width (W1) of a track segment 1 (FIG. 1). This ratio may exist for straight and curved track and scenery pieces. Scenery segments can be printed with many different images and sceneries, such as but not limited to: grass, sidewalks, driveways, parking lots etc. The scenery pieces may also attach to the track segments 20, 22 via magnetic elements. In an embodiment, the scenery pieces attach to each other by magnets in a similar fashion to the way decried for the track segments to attach, where there is an M1 and M4 N polarity magnets and a M2 and M3 S polarity magnets. In this embodiment, the scenery pieces can connect lengthwise via the magnetic elements, but avoid having a clashing of magnetic forces given how a child may arrange the track segments. The scenery pieces may be full length segments (L1) 52, ½ length segments (½ L1) 54, three quarter length segments (¾ L1), or ¼ length segments (¼ L1). The ¼ length scenery segment may have magnets embedded on all four end faces, similar to how the intersection track segments 10 described above may have magnets on all four end faces. The lengths of the scenery pieces allow the scenery to follow on each side of the track segments, as well as follow turns and curves of the track segments. The ¼ L1 scenery piece may allow the scenery to turn around an intersection when a user contracts a track path with intersections. In an embodiment, shown in FIG. 15, some of scenery pieces 56 may also have magnets embedded in the bottom surface of the scenery piece 56 and not visible on the top surface. Such a magnet may also be embedded in a top surface of scenery piece 56 to be visible for a user so a child may identify where it is, or may also be internally embedded, and thus not visible from the top or the bottom. the magnet may be otherwise marked for a child to located. The scenery piece 56 with the magnetic element functions to steady a multitude of stand-alone pieces, such as trees 58, bushes or the like, as shown in FIGS. 16A and 16B.

Figure 17:
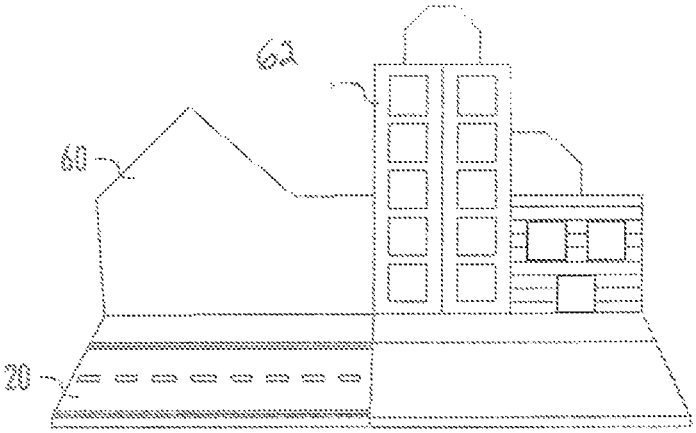
FIG. 17 is a diagram illustrating a perspective view of an arrangement of a plurality of building facades attached to off-road pieces and main track segments according to one embodiment.
Figure 18A:
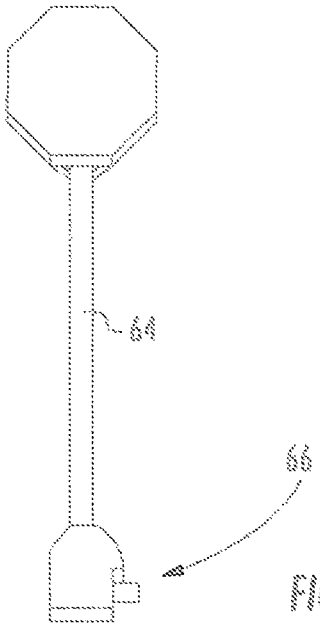
FIG. 18A is a diagram illustrating a perspective view of a stop sign segment with a peg according to one embodiment.
Figure 18B:
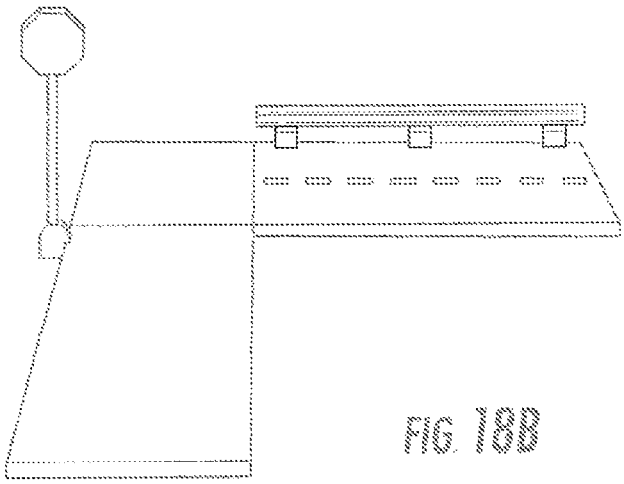
FIG. 18B is a diagram illustrating a perspective view of a stop sign according to FIG. 18*a* but which is shown attached to a track segment according to one embodiment.
Figure 19:
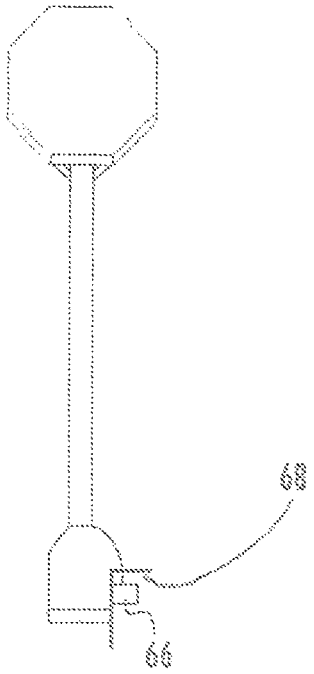
FIG. 19 is a diagram illustrating a perspective view of a stop sign according to FIG. 18*a* showing a gap above the peg according to one embodiment.

FIG. 17 illustrates track pieces 60, 62 representing building facades that may be used in a vertical position alongside one or more track segments, for example, track segment 20. Building facades 60, 62 may include magnetic elements that may facilitate connecting to other building facades, to the track segments, or to other scenic accessories magnetically. In an embodiment, the building facades may have magnetic elements to connect only in a vertical direction to avoid a clashing of magnetic forces given how a child may arrange them, but allowing the building facades to stack vertically. The building facade pieces may have the same planar dimensions of the scenery pieces, i.e., ¼ L1, ½ L1, ¾ L1, or a full length L1, each by the width of ½ W1.

Figure 20A:
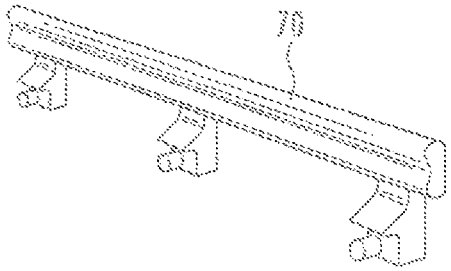
FIG. 20A is a diagram illustrating a perspective view of a guard rail showing grooves according to one embodiment.
Figure 20B:
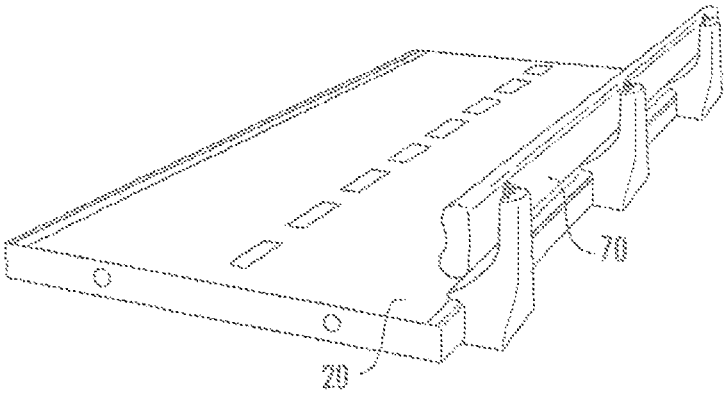
FIG. 20B is a diagram illustrating a perspective view of a guard rail according to FIG. 20A but which is shown being attached to a track segment according to one embodiment.

FIGS. 18A-20B illustrate other scenic accessories that may be used with the track segments according to embodiments of the invention. In some examples, scenic accessories such as stop signs 64 or stop light (battery powered), shown in FIG. 18A-19 may attach to the side of a track segment magnetically, or with exposed pegs 66, shown in FIGS. 18A and 19. The exposed pegs 66 fit into corresponding holes which are provided on a side of a track segment (shown in FIG. 18B) or a scenic landscape piece. Shown in FIG. 19, a gap 68 above the exposed peg 66 facilitates connecting the stop sign 64 to the track segment where gap 68 receives the edge of track segment when peg resides within a corresponding hole in the edge of track segment. Thereby, the scenic landscape piece functions to easily and securely couple to the track segment even if the track segment is on an elevated roadway. FIG. 20A-20B depicts guard rails 60 that may also be connected to track segments using pegs and gaps, such as pegs and gaps depicted in FIGS. 18A-19. Other scenic accessories that may use pegs and gaps include telephone poles, street lights, trees and bushes that may also attach the same way.

Figure 21A:
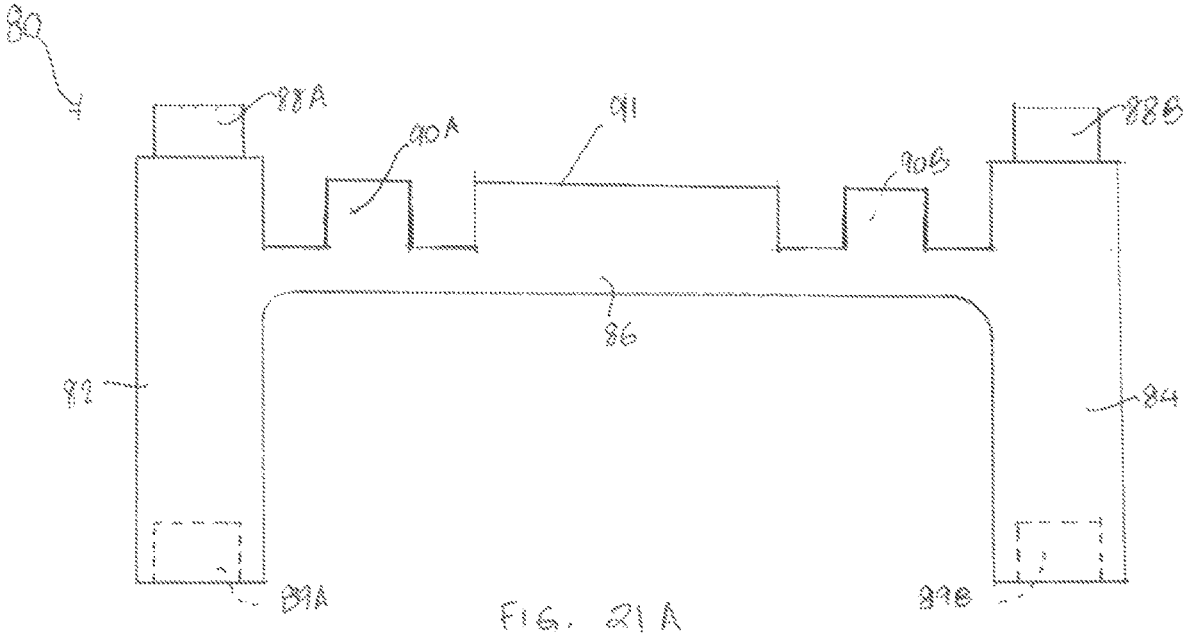
FIG. 21A is a diagram illustrating an elevation view of a riser according to another embodiment.
Figure 21B:
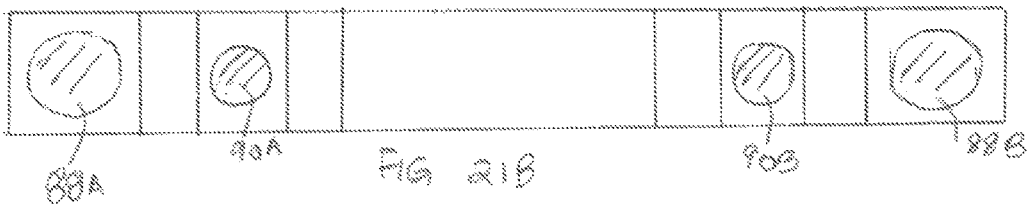
FIG. 21B is a diagram illustrating a plan view of the riser of FIG. 21A according to one embodiment.
Figure 22A:
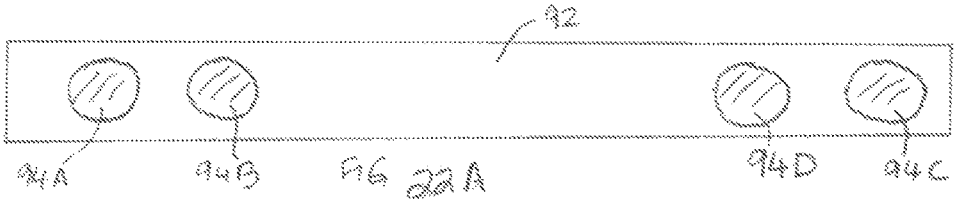
FIG. 22A is a diagram illustrating a plan view of a support bar according to one embodiment.
Figure 22B:
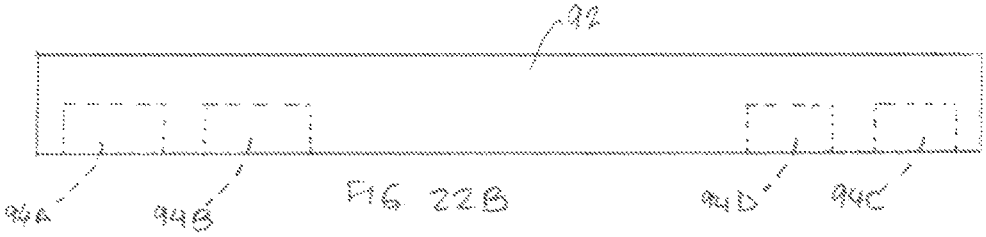
FIG. 22B is a diagram illustrating an elevation view of the support bar of FIG. 22A according to one embodiment.
Figure 22C:
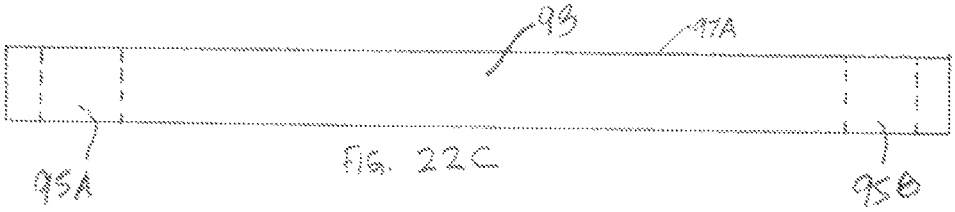
FIG. 22C is a diagram illustrating a plan view of a support bar for use with the riser of FIG. 21A according to one embodiment.

FIGS. 21A-21B and 22C depict track components that facilitate building bridges and other multiple levels of track according to another embodiment of the invention. For example, FIGS. 21A-21B depict an elevation view of a riser 80 (or called an arch) that includes magnetic elements while FIG. 22C depict an elevation view of support bar 93 with holes.

As shown in FIGS. 21A-21B, riser 80 may be substantially similar to riser 30 that is shown and described in FIG. 9 but includes magnets for coupling riser 80 to support bar 93 (FIG. 22C). For example, riser 80 includes vertical columns 82, 84 that are coupled together to a horizontal segment 86. Each column 82, 84 includes respective cylindrical-shaped dowels 88A and 88B, which emanate vertically from a top surface of each column 82, 84. Dowels 88A and 88B can include magnets. Each column 82, 84 includes respective holes 89A and 89B that receive substantially similar dowels from other risers and frictionally couple each column 82, 84 to other substantially-similar risers, so as to build multiple levels of track. Horizontal segment 86 connects vertical column 82 and vertical column 84 and includes cylindrical-shaped dowels 90A and 90B. Dowels 90A and 90B are provided in channels in horizontal segment 86 and are configured to couple riser 80 to one or more support bar 93 (shown in FIG. 22C). In an embodiment, dowels 90A and 90B may have a height with a top surface that is flush with a top surface of center portion 91 of horizontal segment 86. The dowels 90A and 90B can receive holes 95A and 95B in respective support bars, for example, support bar 93 shown in FIG. 22C and causes support top surface 97A of support bar 93 to be flush with the top surface of center portion 91.

Referring to FIG. 22C, support bar 93 is generally elongated and planar in shape and includes through-holes 95A-95B that traverse support bar 93 in an orthogonal direction to the longitudinal length of support bar 93 and emanating from a top surface of support bar 93. Holes 95A-95B are configured to couple support bar 93 to riser 80 through frictional coupling between dowels 90A, 90B and holes 95A, 95B to keep riser 80 connected to support bar 93. Two support bars, for example support bar 93, may be configured to be coupled to two substantially similar risers such as, for example, riser 80 through dowels 90A, 90B on each riser. The riser 80 and support bar 93 may be configured to connect to track segments, for example, track segments 1, 10 and 20, and provide for different scenes such as highways, or mountainous regions. The bridges (shown in FIGS. 8A and 8B) may include curved ramps 38 (shown in FIGS. 8A-8B and 11C) that sit on the edge of the risers 100 with a platform piece 36 (shown in FIGS. 8B and 11C) on top support bars 93 extending between the risers 80. Also, a surface under the platform created by support bars 93 can receive at least one full length track segment, for example, track segment 20, connected to an intersection piece 10 or 22, which may connect to other full or half length pieces.

Figure 23:
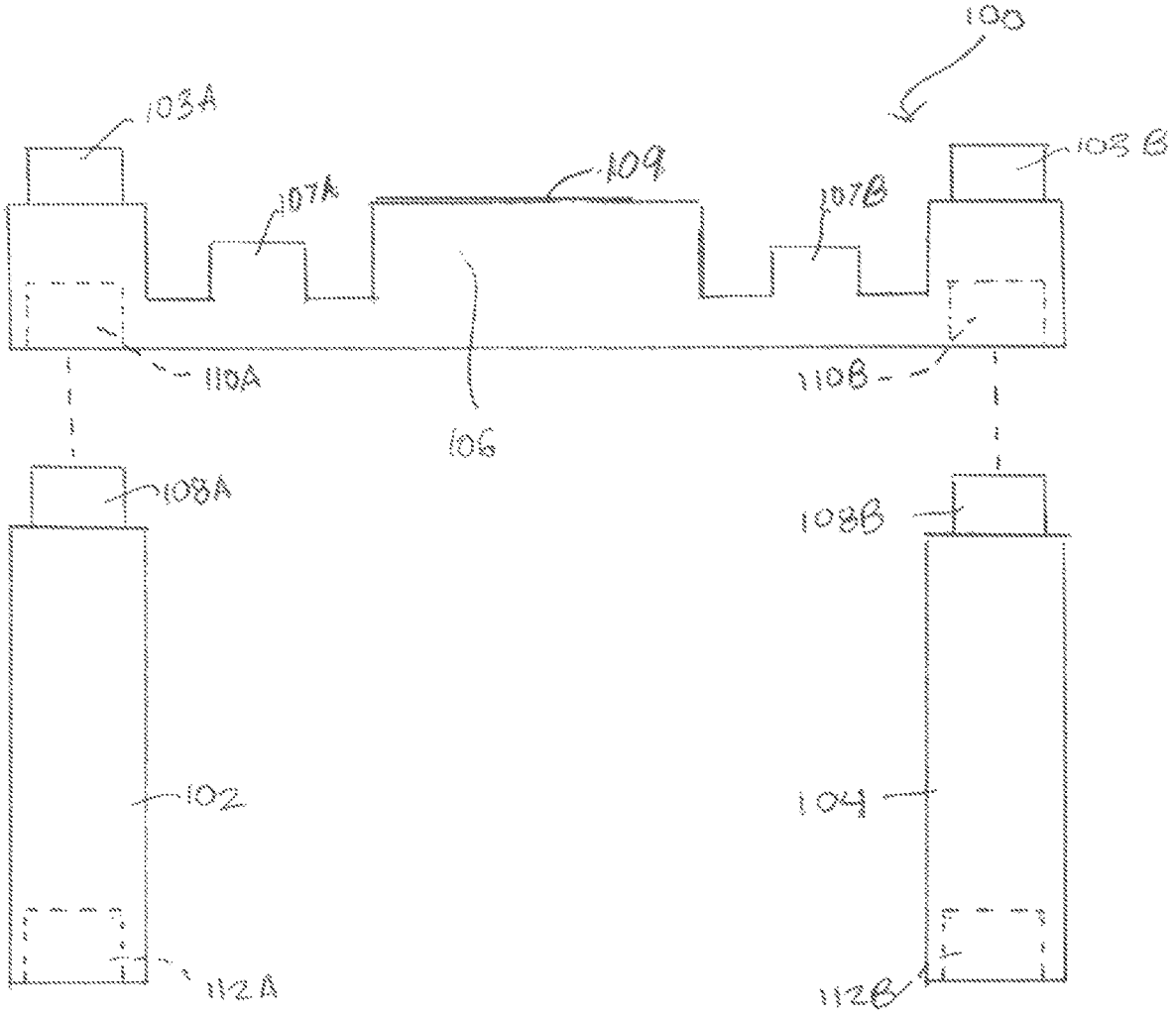
FIG. 23 is a diagram illustrating an exploded view of a riser according to another embodiment.

FIG. 23 depicts an elevation exploded view of riser 100 according to another embodiment of the invention. For example, FIG. 23 depicts an elevation view of a riser 100 (or called an arch) that includes magnetic elements including dowels 107A and 107B in bar 106 with magnetic elements. Riser 100 may be substantially similar to riser 80 that is shown and described in FIG. 21A but includes magnets for coupling riser 100 to support bars 92 (FIGS. 22A and 22B).

Riser 100 includes vertical columns 102, 104 that are coupled together to a horizontal segment 106. Dowels 103A, 103B in each column 102, 104 emanate vertically from a top surface of each column 102, 104 and can include magnets. Riser 100 may be substantially similar to riser 80 of FIGS. 21A-21B but includes a multiple component riser 100 with columns 102, 104 that may be selectively coupled to horizontal segment 106. Each column 102, 104 includes a respective dowel 108A and 108B that is configured to be magnetically attached to respective holes 110A and 110B in horizontal segment 106. Horizontal segment 106 is substantially similar to horizontal segment 86. Each column 102, 104 includes respective holes 112A and 112B that receive substantially similar dowels from other risers and frictionally couple each column 102, 104 to other substantially-similar risers, so as to build multiple levels of track. Dowels 107A and 107B are provided in channels in horizontal segment 106 and are configured to couple riser 100 to support bars 92 (shown in FIG. 22A-22B). In an embodiment, dowels 107A and 107B may have a height that is configured to receive support bar 92 and cause top surface of support bar 92 to be flush with a top surface 109 of center portion 91 of horizontal segment 86. For example, dowels 107A and 107B can receive holes 94A, 94C or holes 94B, 94D in support bar 92 shown in FIG. 22B and causes support top surface of support bar 92 to be flush with the top surface 109.

Referring to FIGS. 22A-22B, support bar 92 is generally elongated and planar in shape and includes holes 94A-94D that include magnets embedded in the holes 94A-94D. Holes 94A-94D are configured to couple support bar 92 to riser 100 and the magnetic force of attraction between respective magnets in dowels 90A, 90B and holes 94A, 94C or holes 94B and 94D keep riser 100 connected to support bar 92. Two support bars, for example support bar 92, may be configured to be coupled to two substantially similar risers such as, for example, riser 100 through dowels 107A, 107B on each riser and either holes 94A and 94C or holes 94B and 94D. Interchanging the coupling with either holes 94A and 94C or holes 94B and 94D facilitates creating a varying gap between two risers, for example riser 100, so as to receive varying lengths of track segments either on a platform created by support bars 92 or under the support bar 92 on a surface that the columns 102, 104 rest upon. For example, the surface under the platform created by support bars 92 can receive at least one full length track segment connected to an intersection piece that may connect to other full or half length pieces. If a riser 100 and a support bar 92 are at the longer configuration, then a user may turn from a full track piece under a platform and make that turn within the area under the platform just inside the riser 100. If a riser 100 and a support bar 92 are at the shorter configuration, then a user may turn from a full track piece under a platform just outside the riser 100. Also for example, at its widest connection combination, two track segments having width W1 may also fit side by crossing under a platform, or perhaps, one track segment of width W1 as well at one scenery piece on each side may cross under the platform. In that example, a user may have a road with sidewalks pass under a bridge. The riser 100 and support bar 92 may be configured to connect to track segments, for example, track segments 1, 10 and 20, and provide for different scenes such as highways, or mountainous regions. The bridges (shown in FIGS. 8A and 8B) may include curved ramps 38 (shown in FIGS. 8A-8B and 11C) that sit on the edge of the risers 100 with a platform piece 36 (shown in FIGS. 8B and 11C) on top support bars 92 extending between the risers 100.

The following examples pertain to further embodiments.

Example 1 is a playset having multiple configurations. The plates includes a plurality of track segments that are configured to be selectively connected to each other, wherein the plurality of track segments comprise: a plurality of main track segments, wherein each main track segment includes a main track body with first top and bottom surfaces, a first thickness, two main track end faces and at least one magnetic element embedded within the first thickness at each main track end face; wherein a first length of the main track segment is twice a width of the main track segment; a plurality of intersection pieces, wherein each track intersection piece includes an track intersection piece body with second top and bottom surfaces, a second thickness, four track intersection end faces and at least one magnetic element embedded within the second thickness at each track end face; wherein a second length of the track intersection piece is equal to a width of the track intersection piece; and a plurality of curved track segments, wherein each curved track segment includes a curved track body with third top and bottom surfaces, a third thickness, curved track end faces and at least one magnetic element embedded within the third thickness at each curved track end face; wherein the main track segment is configured to be directly connectable to a track intersection piece at the main track end faces and the track intersection end face; and wherein two main track segments are connectable at 90 degrees via the track intersection piece, the track intersection piece directly adjoining each of the main track segments via two intersection end faces 90 degrees apart.

In Example 2, the subject matter of Example 1 can include a plurality of arches, wherein each arch includes two vertical leg portions connected by a horizontal portion; and a plurality of support beams, wherein each support beam includes an elongated portion that terminates into first and second ends; wherein a first and second arch of the plurality of arches are configured to be coupled to each other via two support beams to form an elevated platform, wherein the first arch is coupled to respective first ends of the two support beams and the second arch is coupled to respective second ends of the two support beams.

In Example 3, the subject matter of Example 2 can include a first platform that is configured to be connectable to additional support beams and another arch to form a second elevated platform.

In Example 4, the subject matter of Example 3 can include a riser track segment, the riser track segment including a first end portion with a first height and a second end portion with a second height; wherein the first height is at a ground plane and the second height is elevated from the ground plane.

In Example 5, the subject matter of Example 4 can include a riser track segment that is configured to be connectable to the platform for building a second level of track segments; wherein the second level of track segments includes the second end portion being coupled to the horizontal portion of an arch.

In Example 6, the subject matter of Example 5 can include an elevated platform that is configured to receive the main track segment for providing an elevated road structure.

In Example 7, the subject matter of Example 6 can include an elevated road structure that is configured to be an overpass over one or more of the track segments.

In Example 8, the subject matter of Example 1 to 7 can include a plurality of scenic accessories, wherein each scenic accessory is configured to be coupled to a top surface of at least one of the main track segment, the intersection piece or the curved track segment.

In Example 9, the subject matter of Example 8 wherein the scenic accessory includes magnetic elements that is configured to be magnetically connected to the segments.

In Example 10, the subject matter of Example 9 can include, wherein each scenic accessory includes extruding pegs that is configured to be connected to holes on the segments.

In Example 11, the subject matter of Example 8 can include, wherein each scenic accessory is selected from the group consisting of signs, buildings, and foliage.

In Example 12, the subject matter of Example 1 can include, wherein the main track segment further comprises the magnetic element and a metallic cylinder at each main track end face; wherein each of the magnetic element and the metallic cylinder are disposed in individual holes in the main track body; and wherein the magnetic element and the metal cylinder at a first main track end face is diagonal to a corresponding magnetic element and metal cylinder at the opposite main track end face.

In Example 13, the subject matter of Example 1 can include, wherein each of the first, second and third top and bottom surfaces includes designs, wherein the designs are one of road designs, street designs, terrain designs, dirt path designs, off-road designs, snowy road designs, and cobblestone designs.

In Example 14, the subject matter of Example 13 can include, wherein each of the first, second and third top and bottom surfaces is configured to be rotated upside down and face in an opposite direction from its original position.

In Example 15, the subject matter of Example 13 can include, wherein each of the first, second and third top surfaces track segments contains raised tracks for receiving train wheels.

In Example 16, the subject matter of Example 13 can include, wherein each of the main track segment, intersection segment and curved track segment includes an electrical conductor on each end of the track segments, wherein the electrical conductor is configured to conduct electricity through the track segments.

In Example 17, the subject matter of Example 1 can include, wherein the plurality of main track segments includes one or more of a full-length track or a half-length length track.

In Example 18, the subject matter of Example 1 can include, wherein the plurality of curved track segments includes track segments having a radius of curvature of one or more of one-eighth of a circle, two portions of one-eighth of a circle connected at an end or one-sixteenth of a circle.

In Example 19, the subject matter of Example 1 can include, wherein each of the main track segment, intersection segment and curved track segment tracks comprises two magnetic elements embedded in each of the end faces; wherein a first magnetic element includes a north end and a second magnetic element includes a south end; and wherein the first magnetic element at a first end is diagonal to a magnetic element at a second end.

In Example 20, the subject matter of Example 1 can include, wherein the at least one magnetic element in each of the segments is co-planar with a side of the end faces for providing smooth edge magnetic attachment between at least two of the segments.

In Example 21, the subject matter of Example 2 can include, further comprising one or more of a base piece and a connector for stacking a first arch on top of another arch and creating a multi-level construction.

Example 22 is a method of using a playset, comprising: providing a plurality of track segments, wherein the plurality of track segments comprise: a plurality of main track segments, wherein each main track segment includes a main track body with first top and bottom surfaces, a first thickness, two main track end faces and at least one magnetic element embedded within the first thickness at each main track end face; wherein a first length of the main track segment is twice a width of the main track segment; a plurality of intersection pieces, wherein each intersection piece includes a intersection piece body with second top and bottom surfaces, a second thickness, four intersection end faces and at least one magnetic element embedded within the second thickness at each intersection end face; wherein a second length of the intersection piece is equal to a width of the intersection piece; and a plurality of curved track segments, wherein each curved track segment includes a curved track body with third top and bottom surfaces, a third thickness, curved track end faces and at least one magnetic element embedded within the third thickness at each curved track end face; directly connecting the main track segment to the intersection piece at the main track end faces and the intersection end face; wherein two main track segments of the plurality of main track segments are connectable at 90 degrees via the intersection piece, the intersection piece directly adjoining each of the main track segments via two directly adjacent intersection end faces.

In Example 23, the subject matter of Example 22 can include connecting the first platform to additional support beams and another arch to form a second elevated platform.

In Example 24, the subject matter of Example 22 to 23 can include connecting a riser track segment to one or more track segments, the riser track segment including a first end portion with a first height and a second end portion with a second height; wherein the first height is at a ground plane and the second height is elevated from the ground plane.

In Example 25, the subject matter of Example 24 can include, connecting the riser track segment to the platform for building a second level of track segments; wherein the second level of track segments includes the second end portion being coupled to the horizontal portion of an arch.

In Example 26, the subject matter of Example 22 can include receiving the main track segment In Example 27, the subject matter of Example 26 can include, wherein the elevated road structure is configured to be an overpass over one or more of the track segments.

In Example 28, the subject matter of Example 22 to 27 can include, further comprising connecting at least one scenic accessory to the main track segment, wherein each scenic accessory is configured to be coupled to a top surface of at least one of the main track segment, the intersection piece or the curved track segment; wherein each scenic accessory is selected from the group consisting of signs, buildings, and foliage.

In Example 29, the subject matter of Example 28 can include, connecting each of the scenic accessories to the main track segment with magnetic elements.

In Example 30, the subject matter of Example 28 to 29 can include, wherein each scenic accessory includes extruding pegs that is configured to be connected to holes on the main track segment.

In Example 31, the subject matter of Example 22 can include, wherein the main track segment further comprises the magnetic element and a metallic cylinder at each main track end face; wherein each of the magnetic element and the metallic cylinder are disposed in individual holes in the main track body; and wherein the magnetic element and the metal cylinder at a first main track end face is diagonal to a corresponding magnetic element and metal cylinder at the opposite main track end face.

In Example 32, the subject matter of Example 22 can include, further comprising rotating each of the first, second and third top and bottom surfaces upside down and face in an opposite direction from its original position.

In Example 33, the subject matter of Example 22 can include, further comprising receiving train wheels on raised tracks at each of the first, second and third top surfaces track segments.

In Example 34, the subject matter of Example 22 can include, wherein each of the main track segment, intersection segment and curved track segment includes an electrical conductor on each end of the track segments, wherein the electrical conductor is configured to conduct electricity through the track segments.

In Example 35, the subject matter of Example 22 can include, wherein the plurality of main track segments includes one or more of a full-length track or a half-length length track.

In Example 36, the subject matter of Example 22 can include, wherein the plurality of curved track segments includes track segments having a radius of curvature of one or more of one-eighth of a circle, two portions of one-eighth of a circle connected at an end or one-sixteenth of a circle.

In Example 37, the subject matter of Example 22 can include, wherein each of the main track segment, intersection segment and curved track segment tracks comprises two magnetic elements embedded in each of the end faces; wherein a first magnetic element includes a north end and a second magnetic element includes a south end; and wherein the first magnetic element at a first end is diagonal to a magnetic element at a second end.

In Example 38, the subject matter of Example 22 can include, wherein the at least one magnetic element in each of the segments is co-planar with a side of the end faces for providing smooth edge magnetic attachment between at least two of the segments.

In Example 39, the subject matter of Example 22 can include, further comprising one or more of a base piece and a connector for stacking a first arch on top of another arch and creating a multi-level construction.

In Example 40, the subject matter of Example 1 and 22 can include, further comprising a riser with magnetic elements and a support bar with magnetic elements.

In Example 41, the subject matter of Example 40 can include, wherein the riser includes two vertical portions that are coupled together with a horizontal segment; and wherein the each of the vertical portions and horizontal segment includes magnetic elements.

In Example 42, the subject matter of Example 41 can include, wherein each vertical portion includes a cylindrical dowel with a first magnetic element and the horizontal segment includes a second plurality of dowels with second magnetic elements.

In Example 43, the subject matter of Examples 41 to 42 can include, wherein each cylindrical dowel is configured to be coupled to corresponding holes in other risers with magnetic attraction.

In Example 44, the subject matter of Examples 41 to 43 can include, wherein the support bar includes holes that includes third magnetic elements.

In Example 45, the subject matter of Examples 41 to 44 can include, wherein the holes in the support bar are configured to be coupled to the respective second magnetic elements in the second plurality of dowels.

In Example 46, the subject matter of Examples 41 to 45 can include, wherein each vertical portion is fixed to the horizontal segment.

In Example 47, the subject matter of Examples 41 to 45 can include, wherein each vertical portion is detachably coupled to the horizontal segment.

In Example 48, the subject matter of Example 1 can include, multiple configurations of main adjacent segments, adjacent intersection segments, curved adjacent segments tracks, comprising: a plurality of adjacent segments that are configured to be selectively connected to each other and placed adjacent to the plurality of track segments, wherein the plurality of adjacent segments further comprising: a plurality of main adjacent segments, wherein each main adjacent segment includes a main adjacent body with first top and bottom surfaces, a main adjacent thickness, two main adjacent end faces and at least one magnetic element embedded within the main adjacent thickness at each main adjacent end face; wherein the first width of the main track segment is twice a first width of the main adjacent segment and a first length of main adjacent segments is equal to, three quarters of or one half of the first length of a main track segment; a plurality of adjacent intersection pieces, wherein each adjacent intersection piece includes a adjacent intersection piece body with second top and bottom surfaces, an adjacent intersection thickness, four adjacent intersection end faces and at least one magnetic element embedded within the adjacent intersection thickness at each adjacent intersection end face; wherein a second length of the adjacent intersection piece is equal to a width of the adjacent intersection piece; and the second length of the track intersection piece is twice the second length of the adjacent intersection piece; and a plurality of curved adjacent segments, wherein each curved adjacent segment includes a curved adjacent body with third top and bottom surfaces, a curved adjacent thickness, curved adjacent end faces and at least one magnetic element embedded within the curved adjacent thickness at each curved adjacent end face; wherein the main adjacent segment is configured to be directly connectable to an adjacent intersection piece of the plurality of adjacent intersection pieces at the adjacent track end faces and the adjacent intersection end face; and wherein two main adjacent segments are connectable at 90 degrees via the adjacent intersection piece, the adjacent intersection piece directly adjoining each of the main adjacent segments via adjacent intersection end faces 90 degrees apart.

It is to be understood that the above description is intended to be illustrative, and not restrictive. For example, the above-described embodiments may be used in combination with each other. Many other embodiments will be apparent to those of skill in the art upon reviewing the above description. The scope of the invention therefore should be determined with reference to the appended claims, along with the full scope of equivalents to which such claims are entitled.

What is claimed is:

1. A play set having multiple configurations, comprising:

a plurality of track segments that are configured to be selectively connected to each other, wherein the plurality of track segments comprise;

a plurality of main track segments, wherein each main track segment includes a top surface having a first play scene and a bottom surface having a second play scene, a main track thickness, two main track end faces and at least a first and a second magnetic element embedded within the main track thickness at each main track end face;

wherein a first length of the main track segment is twice a width of the main track segment; a plurality of track intersection segments, wherein each track intersection segment includes a top surface having the first play scene and a bottom surface having the second play scene, a track intersection thickness, four track intersection end faces and at least a first and a second magnetic element embedded within the track intersection thickness at each track intersection end face; wherein a second length of the track intersection segment is equal to a width of the track intersection segment;

a plurality of curved track segments, wherein each curved track segment includes a top surface having the first play scene and a bottom surface having the second play scene, a curved track thickness, curved track end faces and at least a first and a second magnetic element embedded within the curved track thickness at each curved track end face; and a plurality of transition track segments, wherein each transition segment includes a top surface having portions of both the first play scene and the second play scene, a transition track thickness, at least two transition track end faces and at least a first and a second magnetic element embedded within the transition track thickness at each transition track end face; wherein a width of the transition track segment is equal to the width of the main track segment; and wherein each of the main track segment, intersection segment, curved track segment and transition track segment comprises an exposed surface of the first magnetic element includes a north magnetic end and an exposed surface of the second magnetic element includes a south magnetic end; and wherein each of the main track segment, intersection segment, and curved track segment further comprises the first magnetic element at a first end is diagonal to a first magnetic element at a second end;

wherein each of the transition track segments further comprises the first magnetic element at a first end is diagonal to a second magnetic element at a second end; and wherein the main track segment is configured to be directly connectable to a track intersection segment at the main track end faces and the track intersection end face; wherein two main track segments are connectable at 90 degrees via the track intersection segment, the track intersection segment directly adjoining each of the main track segments via two track intersection end faces 90 degrees apart;

wherein a top surface having the first play scene any of the main track segments, the intersection segment and the curved track segment is aligned with a corresponding top surface having the first play scene of another main track segment, another intersection segment or another curved track segment by direct magnetic connection of said segments; and wherein the first play scene transitions to the second play scene by connecting any of the main track segment, intersection segment and curved track segment having its top surface facing up to another main track segment, another intersection segment or another curved track segment having transition segment having its bottom surface facing up by the placement of the transition segment between said any of the main track segments, intersection track segments and curved track segments.

2. The play set of claim 1, further comprising:

a plurality of arches, wherein each arch includes two vertical leg portions connected by a horizontal portion; and a plurality of support beams, wherein each support beam includes an elongated portion that terminates into first and second ends;

wherein a first and second arch of the plurality of arches are configured to be coupled to each other via two support beams to form an elevated platform, wherein the first arch is coupled to respective first ends of the two support beams and the second arch is coupled to respective second ends of the two support beams.

3. The play set of claim 2, further comprising:

a riser track segment, the riser track segment including a first end portion with a first height and a second end portion with a second height;

wherein the first height is at a ground plane and the second height is elevated from the ground plane.

4. The play set of claim 3, wherein the riser track segment is configured to be connectable to the platform for building a second level of track segments;

wherein the second level of track segments includes the second end portion being coupled to the horizontal portion of an arch.

5. The play set of claim 2, wherein the elevated platform is configured to receive the main track segment for providing an elevated road structure.

6. The play set of claim 5, wherein the elevated road structure is configured to be an overpass over one or more of the track segments.

7. The play set of claim 2, further comprising one or more of a base piece and a connector for stacking a first arch on top of another arch and creating a multi-level construction.

8. The play set of claim 1, wherein the first platform is configured to be connectable to additional support beams and another arch to form a second elevated platform.

9. The play set of claim 1, further comprising at least one scenic accessory, wherein each scenic accessory is configured to be coupled to a top surface of at least one of the main track segment, the intersection segment or the curved track segment, wherein each scenic accessory is selected from the group consisting of signs, buildings, and foliage.

10. The play set of claim 9, wherein each scenic accessory includes magnetic elements that are configured to be magnetically connected to the segments.

11. The play set of claim 9, wherein each scenic accessory includes extruding pegs that are configured to be connected to holes on the segments.

12. The play set of claim 1, wherein the main track segment further comprises the first and the second magnetic elements and a metallic cylinder at each main track end face;

wherein each of the first and the second magnetic elements and the metallic cylinder are disposed in individual holes in the main track body; and wherein the first and the second magnetic elements and the metal cylinder at a first main track end face is diagonal to a corresponding magnetic element and metal cylinder at the opposite main track end face.

13. The play set of claim 1, wherein each of the first, second and third top and bottom surfaces is configured to be rotated upside down and face in an opposite direction from its original position.

14. The play set of claim 1, wherein each of the first, second and third top surfaces track segments contains raised tracks for receiving train wheels.

15. The play set of claim 1, wherein each of the main track segment, intersection segment and curved track segment includes an electrical conductor on each end of the track segments, wherein the electrical conductor is configured to conduct electricity through the track segments.

16. The play set of claim 1, wherein the plurality of main track segments includes one or more of a full-length track or a half-length length track.

17. The play set of claim 1, wherein the at least one of a plurality of curved track segments to form a pie-piece shaped closed track includes two track segments having a radius of curvature of one-eighth of a circle, or one track segment having a radius of curvature of one-eighth of a circle and two track segments having a radius of curvature of one-sixteenth of a circle.

18. The play set of claim 1, wherein the at least one magnetic element in each of the segments is co-planar with a side of the end faces for providing smooth edge magnetic attachment between at least two of the segments.

* * * * *